US005957334A

United States Patent [19]

Rosario

[11] Patent Number: 5,957,334

[45] Date of Patent: Sep. 28, 1999

[54] TOOTHPASTE DISPENSING APPARATUS

[76] Inventor: Antonio Rosario, 2328 S. Franklin St., Philadelphia, Pa. 19148

[21] Appl. No.: 09/048,417

[22] Filed: Mar. 26, 1998

[51] Int. Cl.[6] ..... B65D 35/28

[52] U.S. Cl. ..... 222/102

[58] Field of Search ..... 222/102, 105

[56] References Cited

U.S. PATENT DOCUMENTS

| | | | |
|---|---|---|---|
| 2,578,472 | 11/1951 | Gunnarson | 222/102 |
| 3,501,054 | 3/1970 | Maurice | 222/102 |
| 4,027,784 | 6/1977 | Mattson | 222/102 |
| 4,418,840 | 12/1983 | Gardner, Sr. | 222/96 |
| 4,629,095 | 12/1986 | Smith | 222/102 |
| 5,397,030 | 3/1995 | Williams | 222/96 |
| 5,573,138 | 11/1996 | Lin | 222/96 |

*Primary Examiner*—Philippe Derakshani
*Attorney, Agent, or Firm*—Henderson & Sturm

[57] ABSTRACT

A toothpaste dispensing apparatus 10 including a housing unit 11, dimensioned to slidably receive a dispensing unit 12 having a pair of roller elements 41, 42 engageable with the sealed end 101 of the toothpaste tube 100 and further including a closure unit 13 hingedly connected to the housing unit 11 and adapted to arrest the flow of toothpaste from the mouth 102 of the tube 100 which is engaged in a plate element 46 slidably disposed within the housing unit 11. The closure unit 13 cooperates with the dispensing unit 12 to provide a double seal arrangement to maintain the contents of the toothpaste tube 100.

15 Claims, 4 Drawing Sheets

TOOTHPASTE DISPENSING APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of toothpaste dispensing apparatus in general, and in particular to a roller pinch style toothpaste dispenser.

2. Description of Related Art

As can be seen by reference to the following U.S. Pat. Nos. 4,027,784; 4,418,840; 5,397,030; and 5,573,138, the prior art is replete with myriad and diverse roller equipped toothpaste dispensing apparatus.

While all of the aforementioned prior art constructions are more than adequate for the basic purpose and function for which they have been specifically designed, they do not represent the culmination of the development of devices of this type.

In addition, the prior art appears to be remiss with regard to providing adequate means to immobilize and selectively position the open mouth of a tube of toothpaste relative to a closure member to insure the proper seating of the tube mouth with respect thereto.

As a consequence of the foregoing situation, there has existed a longstanding need for a new and improved toothpaste dispensing apparatus that is designed to adjustably position the mouth of the toothpaste tube relative to a closure member, and the provision of such a construction is a stated objective of the present invention.

BRIEF SUMMARY OF THE INVENTION

Briefly stated, the toothpaste dispensing apparatus that forms the basis of the present invention comprises in general, a housing unit, a dispensing unit slidably disposed within the housing unit, and a closure unit hingedly connected to the housing unit.

As will be explained in greater detail further on in the specification, the dispensing unit comprises a framework element slidably disposed in the housing unit and containing a pair of roller elements having at least one elongated axle element that extends through an elongated slot in one side of the housing member.

In addition, the dispensing unit further includes a plate element slidably disposed in the lower portion of the housing member and provided with an aperture in its outboard end dimensioned to receive the mouth of the toothpaste tube. The aperture is provided with a flexible sleeve insert that may be selectively positioned relative to a closure receptacle that is disposed within the hinged closure unit by movement of the plate element.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
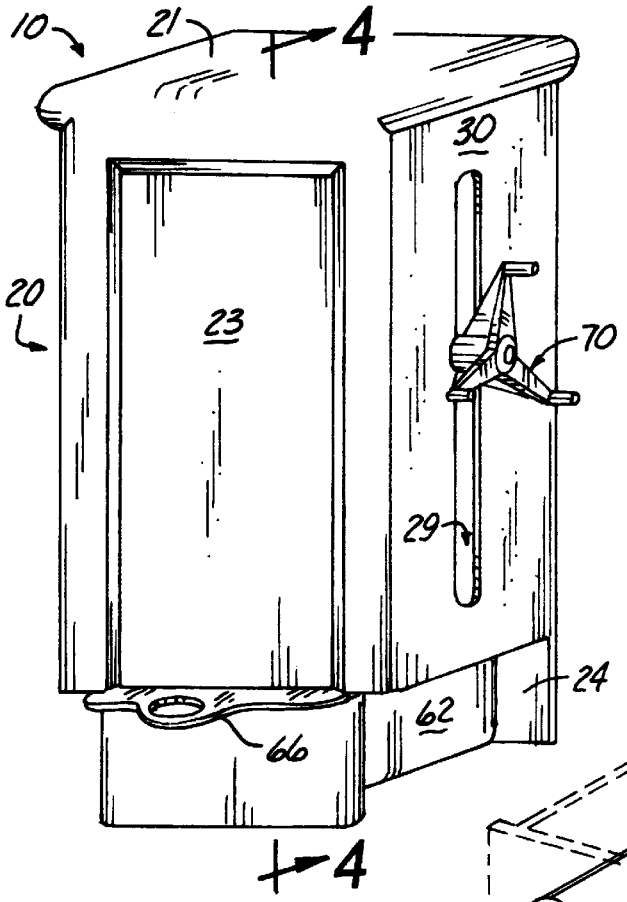
FIG. 1 is a front perspective view of the exterior housing of the toothpaste dispensing apparatus.
Figure 3:
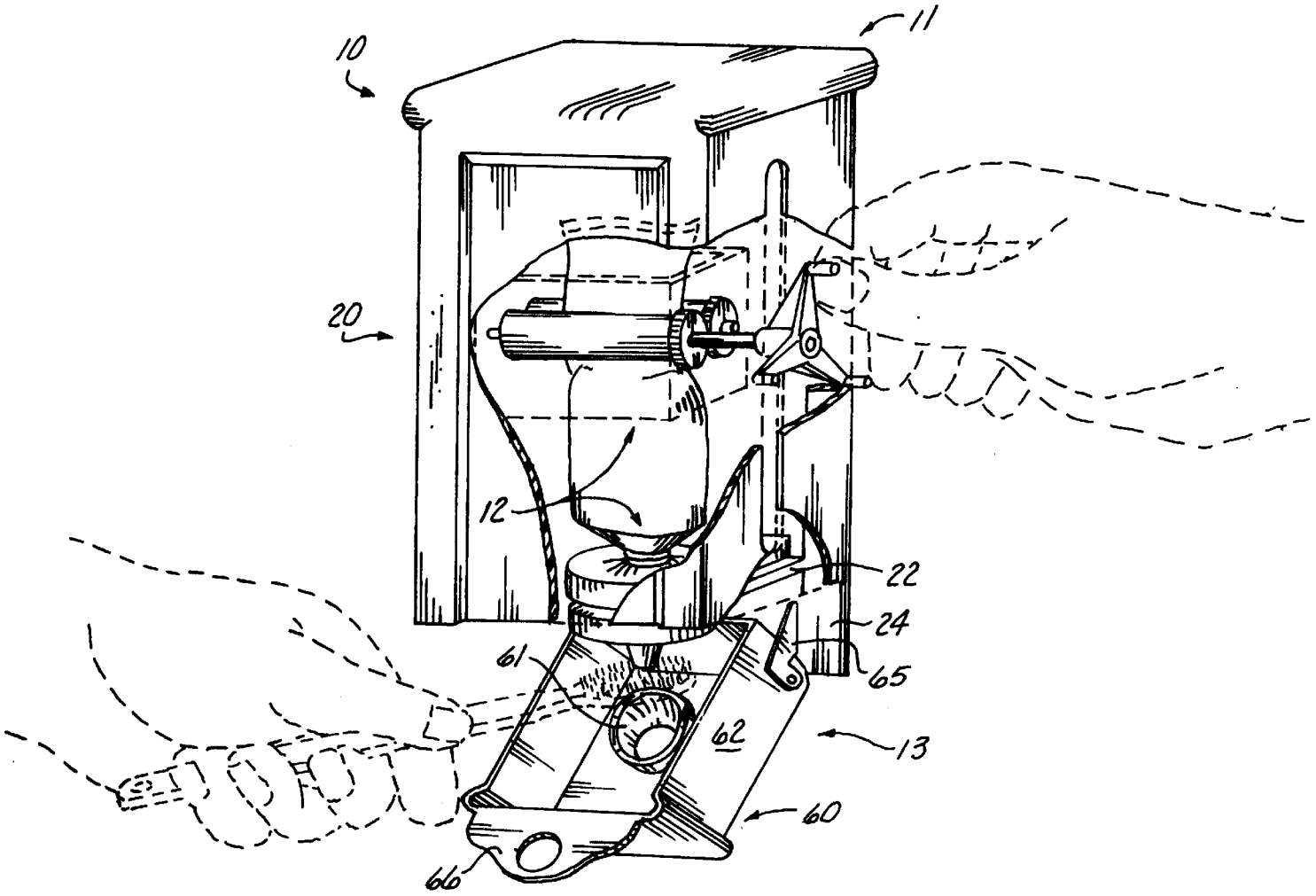
FIG. 3 is a partial cut-away view of the dispensing apparatus.
Figure 5:
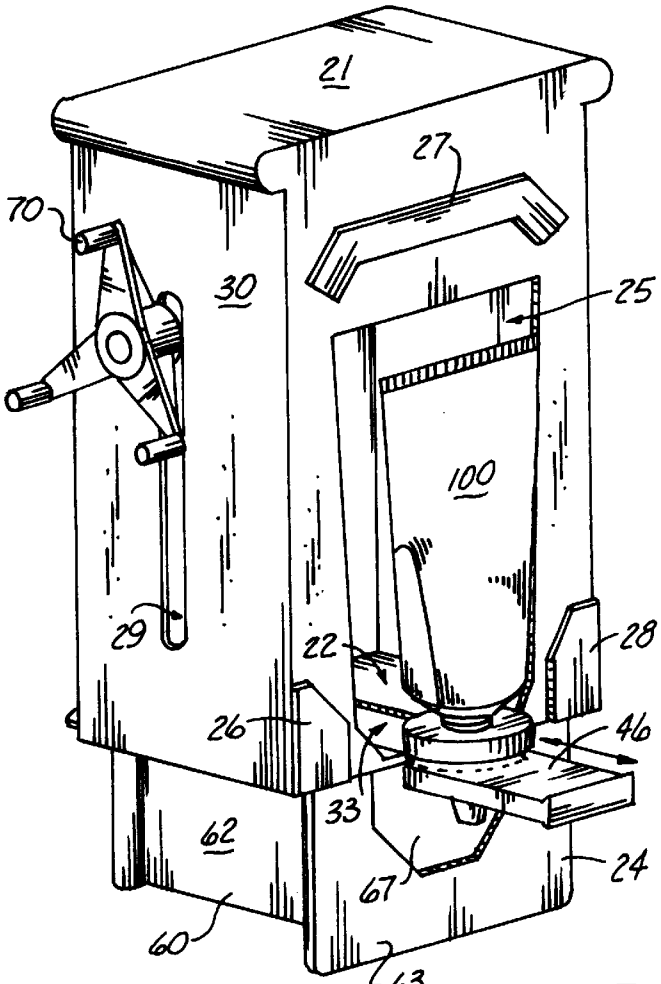
FIG. 5 is a rear perspective view of the apparatus.
Figure 4:
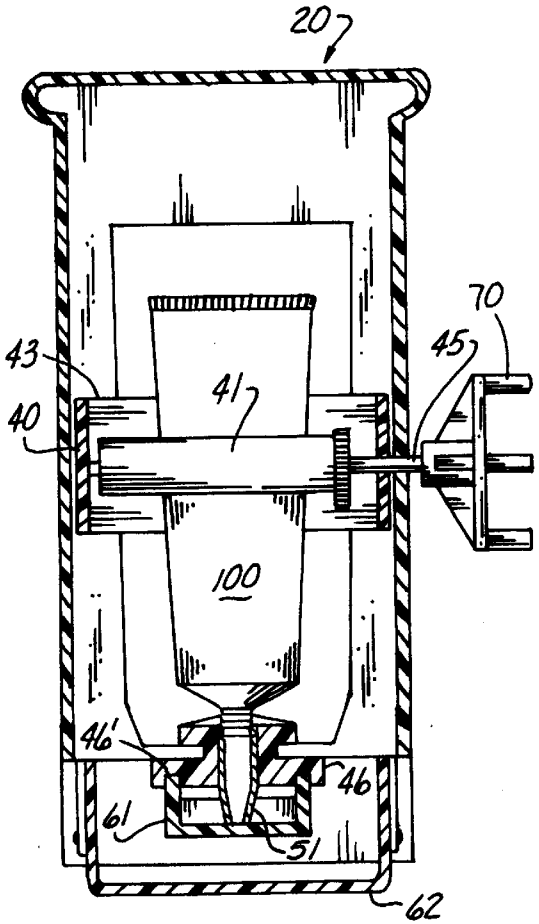
FIG. 4 is a cross-sectional view of the apparatus taken through line 4—4 of FIG. 1.

As can be seen by reference to the drawings, and in particularly to FIG. 1, the toothpaste dispensing apparatus that forms the basis of the present invention is designated generally by the reference number 10. As shown in FIGS. 3 through 5, the apparatus 10 comprises in general, a housing unit 11, a dispensing unit 12, and a hinged closure unit 13. These units will now be described in seriatim fashion.

As can best be seen by reference to FIGS. 1 and 5, the housing unit 11 comprises a generally hollow rectangular housing member 20 having a closed top 21, a slotted bottom 22, a contoured front face 23, an elongated rear face 24 having an enlarged opening 25 and a plurality of raised mounting projections 26, 27, 28, and an elongated aperture 29 formed on at least one side 30 of the housing member.

Figure 2:
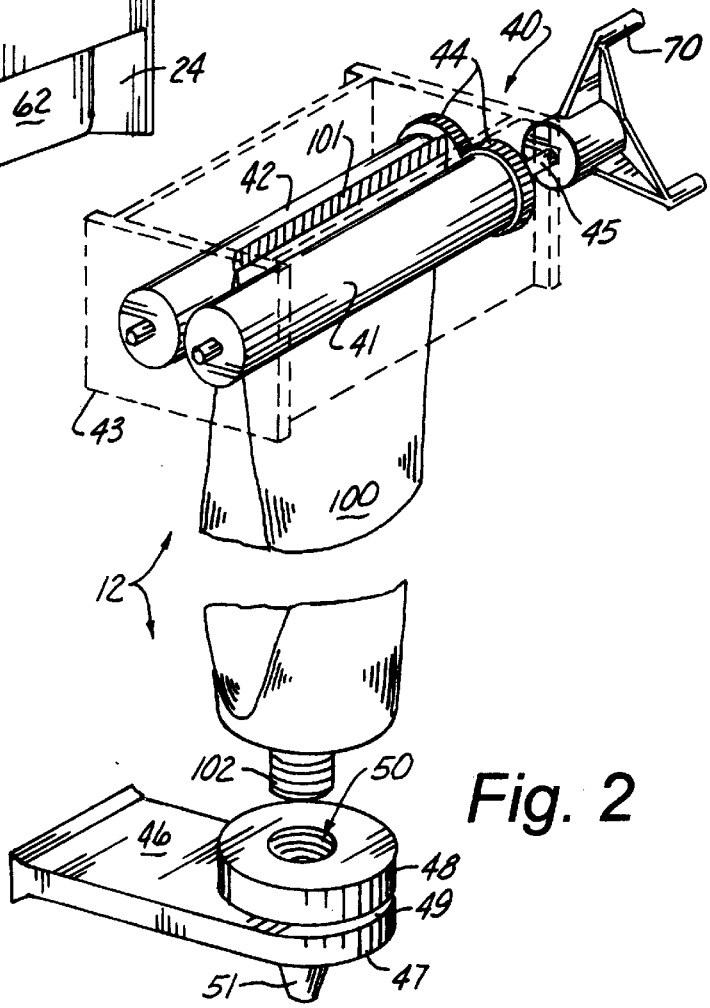
FIG. 2 is an isolated detail view of the dispensing actuator and tube mouth holder.

Turning now to FIGS. 2 through 4, it can be seen that the dispensing unit 12 comprises a dispensing member 40 including a pair of roller elements 41, 42 rotatably disposed in a generally rectangular open framework element 43 dimensioned to be slidably disposed within the hollow interior of the housing member 20. The roller elements 41, 42 are aligned within the framework element 43 in a parallel fashion and provided with gear rings 44 on one end. The rotational movement of one roller element 41 will produce a counter-rotational movement of the other roller element 42.

Furthermore, one of the roller elements 41 is provided with an extended axle 45 dimensioned to be received through the elongated aperture 29 in the housing member 20. The extended axle 45 is further provided with an enlarged handle element 70 to rotate the roller elements 41, 42 in a counter rotating fashion to grip the closed end 101 of a tube of toothpaste 100 to force the contents of the tube of toothpaste 100 through the mouth 102 of the tube 100.

In addition, as shown in FIGS. 2 through 6, the dispenser member 40 also includes a plate element 46 slidably disposed in the bottom portion of the housing member 20. The outboard end 47 of the plate element 46 is provided with enlarged head 48 having a reduced diameter neck portion 49 which are all provided with a vertically oriented threaded dispensing aperture 50. The dispensing aperture 50 is dimensioned to receive the mouth 102 of the toothpaste tube 100 and is further provided with a nozzle insert 51 whose purpose and function will be described presently.

Figure 6:
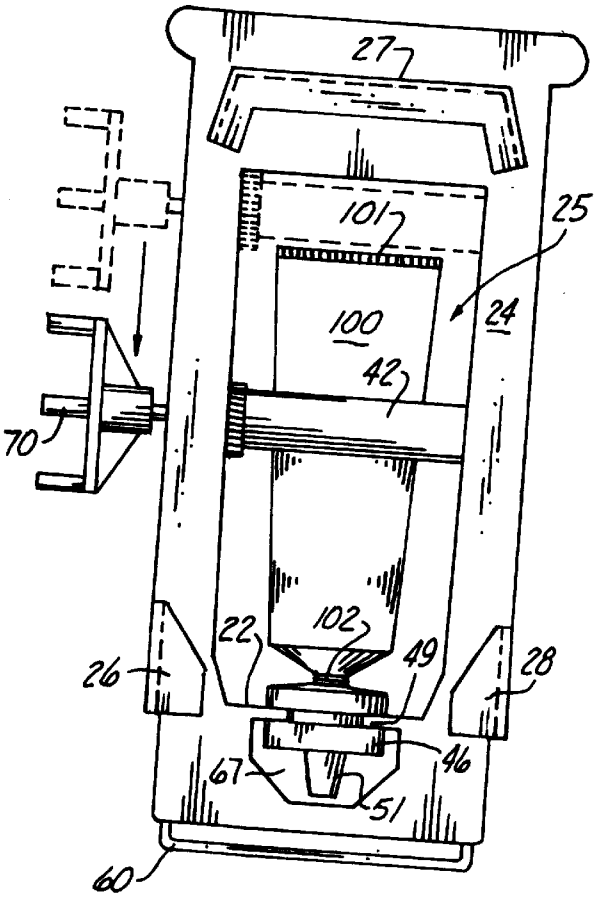
FIG. 6 is a rear elevation view of the apparatus.

As shown in FIGS. 4 through 6, the reduced diameter neck portion 49 of the slidable plate element 46 is dimensioned to be slidably received in the elongated slot 33 formed in the bottom 22 of the housing member 20.

Turning now to FIGS. 3 through 6, it can be seen that the closure unit 13 comprises a closure member 60 pivotally secured on one end to the elongated rear face 24 of the housing member 20. The closure member 60 comprises a generally cylindrical closure receptacle 61 centrally disposed in a generally rectangular closure housing 62 and having a bottom portion 63 dimensioned to sealingly engage the lower end of the nozzle insert 51.

As can be seen by reference to FIGS. 2 through 6, a tube of toothpaste 100 is inserted into the dispensing apparatus 10 by first threading the sealed end 101 of the tube into the space between the roller elements 41, 42. Then the mouth 102 of the tube 100 is engaged with the dispensing aperture 50 in the plate element 46 which is inserted through both the opening 25 in the rear face 24 of the housing member 20 and the opening 67 in the back of the closure housing 62. The reduced neck portion 49 is slidably received in the slot 33 formed in the bottom 22 of the housing member 20. The plate element 46 is then moved towards the front 21 of the housing member 20 until the flexible nozzle insert 51 is positioned to be captively and sealingly engaged by the closure receptacle 61 when the closure member 60 is disposed in the closed position.

In addition, as can best be seen by reference to FIG. 4, the bottom of plate element 46 is further provided with a circular recess 46' which is dimensioned to sealingly engage the top of the cylindrical closure receptacle 61 while the bottom portion 63 of the closure receptacle sealingly engages the bottom of the nozzle insert 51.

When someone wishes to dispense toothpaste from the apparatus 10 the front lip 66 of the closure housing 62 is grasped and pivoted downwardly on the hinge elements 65 to uncover the opening of the nozzle insert 51. The user then positions a toothbrush below the nozzle insert 51 and turns the handle element 46 of the dispenser member 40 to force the rollers 41, 42 into compressive engagement with the sides of the toothpaste tube 100 to force the contents out of the tube mouth 102 and through the nozzle insert 51.

It should also be noted at this juncture that as the contents of the tube 100 are depleted, the dispensing member 40 will move downwardly relative to the interior of the housing member 20 with the extended axle 45 of the handle element 46 traveling downwardly in the elongated aperture 29.

Figure 7:
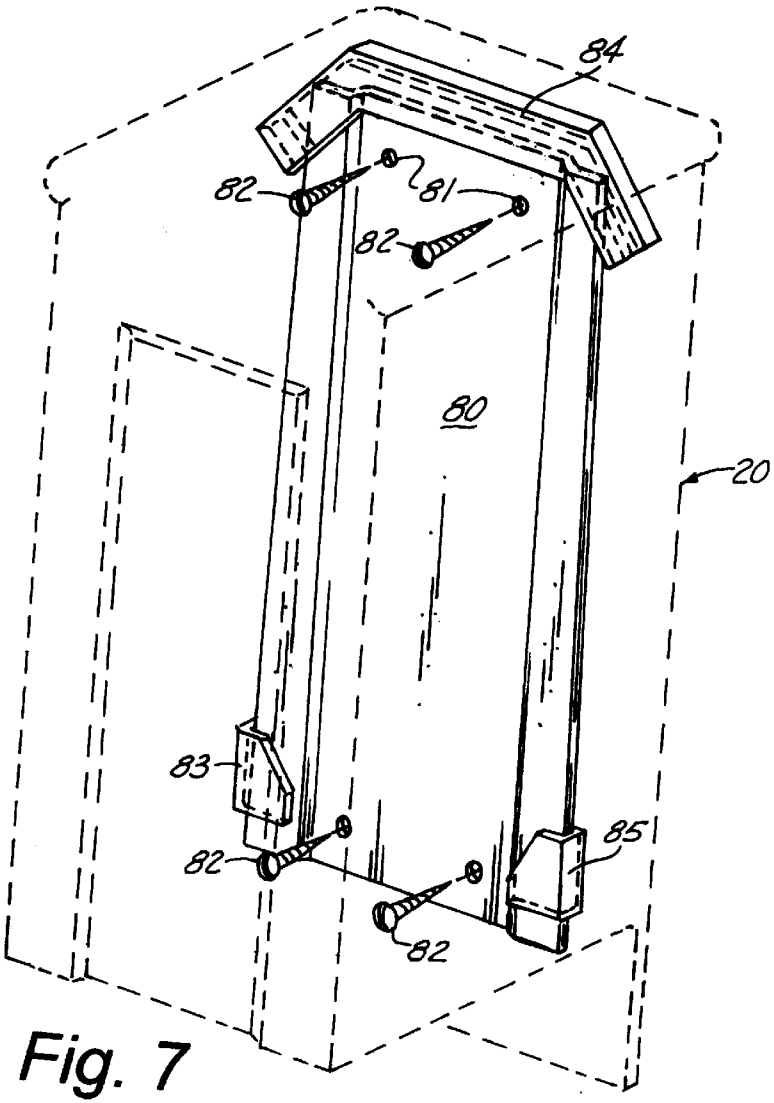
FIG. 7 is an isolated detail view of a mounting plate that may be employed in conjunction with the apparatus.

Turning now to FIGS. 5 through 7, it can be seen that the dispensing apparatus 10 is also provided with a mounting plate 80 provided with a plurality of apertures 81 dimensioned to receive conventional securing means 82 for mounting the mounting plate 80 on a vertical wall surface (not shown). In addition, the mounting plate 80 is provided with a plurality of recesses 83, 84, 85 that will slidably receive the contoured mounting projections 26, 27, 28 on the rear face 25 of the housing member 20 for suspending the housing member 20 from a vertical wall surface in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A toothpaste dispensing apparatus for use with a tube of toothpaste having a sealed end and a tube mouth wherein the apparatus comprises:

a dispenser housing member having a closed top, a slotted bottom, a front face, an elongated rear face provided with an enlarged opening dimensioned to receive the tube of toothpaste; and, at least one side provided with an elongated slot;

a dispensing unit including a framework element dimensioned to be slidably received within the dispenser housing member; a pair of roller elements operatively and rotatably associated with the framework element and one another in parallel fashion, and defining a space between one another which is dimensioned to receive the sealed end of the toothpaste tube; and means associated with said at least one side provided with an elongated slot for imparting counter rotating movement to said pair of roller elements.

2. The apparatus as in claim 1 further comprising:

a closure unit pivotally associated with the housing member.

3. The apparatus as in claim 2 wherein the closure unit includes:

a closure member pivotally secured on one end to the elongated rear face of the housing member.

4. The apparatus as in claim 2 wherein each of the roller elements are provided with geared rings on one end and wherein the geared rings are operatively engaged with one another.

5. The apparatus as in claim 4 wherein one of the roller elements is provided with an elongated axle which projects through the elongated aperture in said at least one side of the housing member.

6. The apparatus as in claim 5 wherein said elongated axle is provided with a handle for imparting rotary motion to one of the roller elements.

7. The apparatus as in claim 6 wherein the dispensing unit further includes:

a plate element slidably received within the housing member and having an outboard end provided with an opening dimensioned to receive the mouth of the tube.

8. The apparatus as in claim 7 wherein the plate element is dimensioned to be received in the enlarged opening in the rear face of the housing member.

9. The apparatus as in claim 8 wherein the plate element is dimensioned to be slidably received in the slotted bottom of the housing member.

10. The apparatus as in claim 6 wherein the opening in the outboard end of the plate element is provided with a nozzle insert.

11. The apparatus as in claim 10 wherein the nozzle insert is dimensioned to be sealingly engaged by the closure unit.

12. The apparatus as in claim 11 wherein the closure unit comprises a closure member including a closure housing pivotally associated with the housing member and having a generally cylindrical closure receptacle having a bottom portion dimensioned to receive and sealingly engage the nozzle insert.

13. The apparatus as in claim 12 wherein the bottom of the plate element is provided with a circular recess which is dimensioned to sealingly engage the top of said cylindrical closure receptacle.

14. The apparatus as in claim 1 further including:

a mounting plate adapted to be releasably engageable with the rear face of the housing member.

15. The apparatus as in claim 13 wherein the rear face of the housing member is provided with a plurality of raised mounting projections and the mounting plate is provided with a like plurality of recesses dimensioned to releasably engage said mounting projections.

* * * * *